United States Patent [19]

Meulenbrug

[11] Patent Number: 4,499,890

[45] Date of Patent: Feb. 19, 1985

[54] HEATER AND A METHOD OF CONTROLLING THE COMBUSTION IN SUCH A HEATER

[75] Inventor: Gerard C. Meulenbrug, Deventer, Netherlands

[73] Assignee: Nederlandse Industriële Maatschappij NEFIT N.V., Deventer, Netherlands

[21] Appl. No.: 311,949

[22] Filed: Oct. 16, 1981

[30] Foreign Application Priority Data

Oct. 16, 1980 [NL] Netherlands ..... 8005717

[51] Int. Cl.[3] ..... F24H 3/00

[52] U.S. Cl. ..... 126/116 R; 431/354; 431/328; 48/180 C

[58] Field of Search ..... 431/12, 175, 180, 285, 431/328, 354, 347, 157, 158; 126/112, 116 R; 48/180 C, 180 P, 180 F, 180.1; 261/DIG. 39, 76, 78 R, 78 A, 116; 239/428, 429, 430, 553, 566

[56] References Cited

U.S. PATENT DOCUMENTS

| | | | |
|---|---|---|---|
| 391,606 | 10/1888 | Hanck | 239/553 |
| 1,149,622 | 8/1915 | Bradshaw | 48/180 F |
| 1,302,914 | 5/1919 | Goreau | 431/285 |
| 1,476,232 | 12/1923 | Zander | 48/180 C |
| 1,625,992 | 4/1927 | Godsey | 239/430 X |
| 1,912,730 | 6/1933 | Schrader | 431/347 |
| 2,666,584 | 1/1954 | Elieuer | 431/75 X |
| 2,838,585 | 6/1958 | Lehrer | 431/19 X |
| 3,193,263 | 7/1965 | Ruff | 431/75 X |
| 3,371,699 | 6/1966 | Riot | 431/90 X |
| 3,907,488 | 9/1975 | Taleahashi et al. | 431/285 X |
| 3,957,420 | 5/1976 | Asai et al. | 431/10 X |
| 4,310,746 | 1/1982 | Ellcern et al. | 126/101 |
| 4,358,414 | 11/1982 | Webster et al. | 261/78 R X |

FOREIGN PATENT DOCUMENTS

| | | | |
|---|---|---|---|
| 2708858 | 9/1978 | Fed. Rep. of Germany | 431/90 |
| 115299 | 5/1918 | United Kingdom | 48/180 |

*Primary Examiner*—Samuel Scott
*Assistant Examiner*—Carl D. Price
*Attorney, Agent, or Firm*—Watson, Cole, Grindle & Watson

[57] ABSTRACT

A heater having a combustion chamber in which a burner and a heat exchanger for fluid to be heated are arranged. The burner is oblong and includes a mixing chamber with a venturishaped cross-section. A converging inlet part of the mixing chamber is connected to a feeding device for supplying air and fuel to the burner. The air and fuel are each supplied through a restriction plate of the feeding device. The restriction plate has two rows of calibrated openings so that a row of incoming air jets and a row of incoming fuel jets are formed. The row of air jets is directed against a deflecting surface incorporated in the upper wall of the inlet part for producing a whirling effect for obtaining an appropriate mixing of air and fuel. A diverging outlet part of the mixing chamber is closed by a burner plate with evenly divided ports.

9 Claims, 5 Drawing Figures

HEATER AND A METHOD OF CONTROLLING THE COMBUSTION IN SUCH A HEATER

BACKGROUND OF THE INVENTION

1. Field of the Invention

The present invention relates to a heater comprising a combustion chamber in which a burner and a heat exchanger for fluid to be heated are arranged, the burner comprising a mixing chamber connected to a fuel feed and a feed for forced air, the outlet side of the mixing chamber being provided with a burner plate comprising evenly divided ports.

2. Description of the Prior Art

A heater of this kind in which the burner operates with a 100% primary air supply and the mixing of the fuel with air takes place in the mixing chamber of the burner, is known from British Patent Application No. 80,27467 Pat. No. 2,063,451 filed on Aug. 22, 1980 in the name of Applicant's Assignee: NEFIT N.V. The burner of this known heater has the drawback that it is not possible to achieve a good mixture of the fuel with air as well as a uniform velocity distribution of the produced mixture along the entire burner plate.

SUMMARY OF THE INVENTION

It is a primary object of the present invention to provide a heater in which the above drawback is obviated and in which the structure of the burner is as compact as possible.

The objects are attained according to the invention in that the mixing chamber of the burner consists of a converging inlet part merging into a diverging outlet part through a narrow passage (throat), the inlet part being connected to a device for feeding air and fuel.

The fuel and air are therefore fed into the mixing chamber through the feeding device. In this manner an intensive mixture may be obtained in the converging inlet part, whereupon the velocity of the mixture decreases in the outlet part, the mixture subsequently leaving the mixing chamber with a uniform velocity through the ports of the burner plate.

In a preferred embodiment of the heater according to the invention the feeding device consists of a housing comprising two separate chambers, one being connected to the air-feed and the other to the fuelfeed, each chamber being in communication with the inlet part of the burner through a set of calibrated openings in a restriction plate. In this way fuel and air will both flow into the mixing chamber through their own set of openings, so that a number of jets are formed and the total energy of these jets can be used for the mixing operation.

According to the invention the inlet part of the mixing chamber comprises deflecting means positioned within the jets of incoming air and/or fuel.

These deflecting means preferably consist of cavities applied in the wall of the inlet part of the mixing chamber. The direction of air and/or fuel jets entering the mixing chamber is thus deviated via said cavities, so causing an intensive mixing in the inlet of the mixing chamber. In an advantageous embodiment of the invention the cavities together form a whirling space which extends to the feeding device.

In a very advantageous embodiment according to the invention the burner is provided with a pressure difference control switch which on the one hand is connected to the mixing chamber and on the other hand to the air supply chamber of the feeding device. With the aid of the pressure difference control switch it can be determined if air is entering into the mixing chamber. In the case that the openings might be blocked, which would cause a dangerous situation, the pressure difference control switch will react and subsequently automatically cut off the gasfeed.

Preferably the pressure difference control switch in the mixing chamber is arranged in the whirling space near the wall of the feeding device comprising the calibrated openings. Thus the pressure difference control switch is connected in the mixing chamber at a point where the static pressure is lower than the pressure of the ambient atmosphere. In this manner it is achieved that also by disconnecting the pressure difference control switch with the mixing chamber, the pressure difference will decrease, so causing the gas supply to the mixing chamber to be cut off.

In accordance with the present invention the mixing chamber of the burner is provided with a separate compartment which extends from the feeding device to the burner plate, the feeding device comprising a separate chamber only being connected with the compartment, the chamber further being connected to a separate fuelfeed. The part of the burner plate corresponding with the compartment can be ignited so that an ignition flame is obtained which is entirely integrated within the burner.

The invention is also embodied in a method of controlling the combustion in a heater such that the temperature of the burner plate is measured and in that the air-fuel ratio in the burner is controlled dependent upon the measured value.

It has been found that at a certain load of the heater the temperature of the burner plate is a base for the percentage of $CO_2$ in the flue gases. With the aid of the $CO_2$ percentage it can be determined whether the combustion takes place with the correct air-fuel ratio. If the $CO_2$ percentage is high the danger exists of CO being produced while a too low $CO_2$ percentage decreases the efficiency of the combustion. Due to the control of the air-fuel ratio, dependent upon the temperature of the burner plate, a constant optimum mixing ratio may be maintained.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENTS

Figure 1:
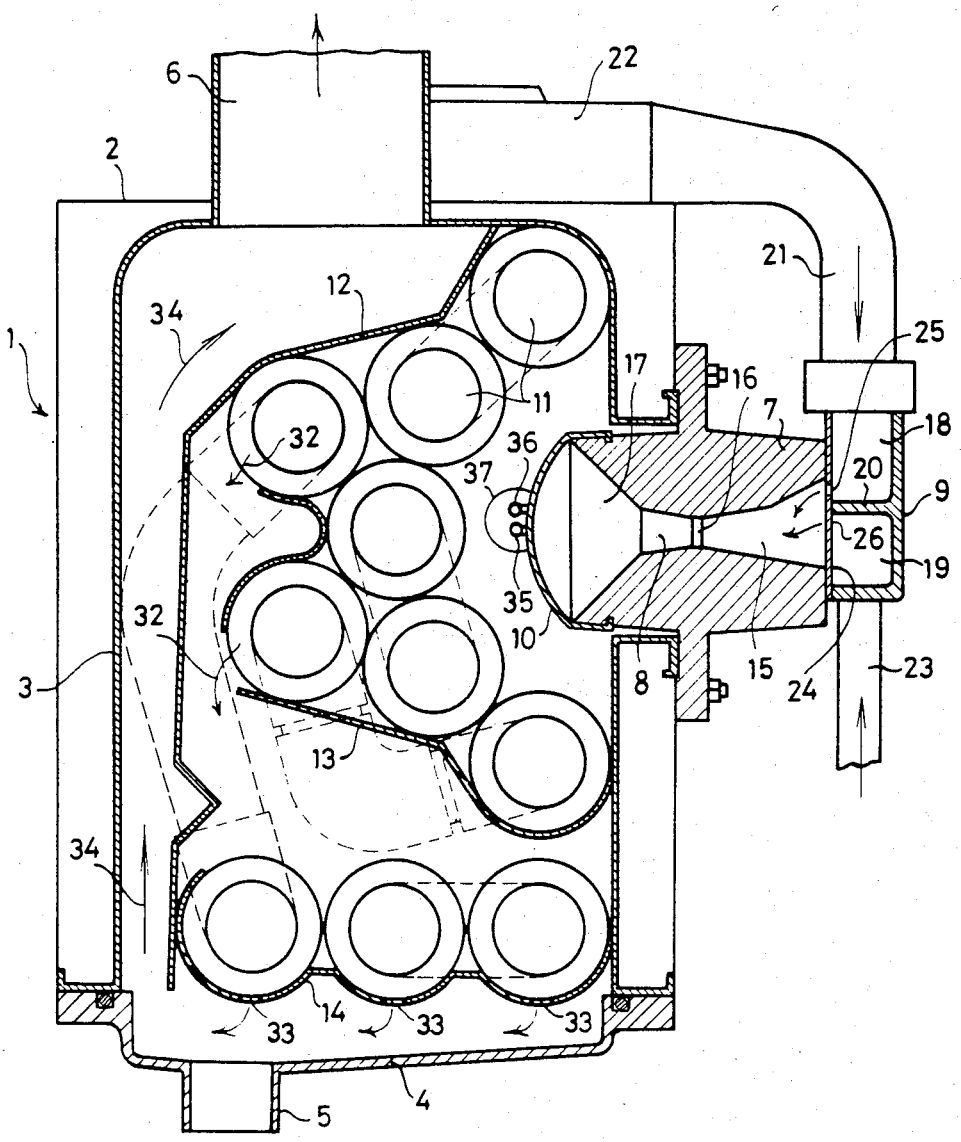
FIG. 1 is a schematic vertical section through a combustion chamber of a heater according to the invention.

Referring now to FIG. 1 the combustion chamber of the heater according to the invention consists of a casing generally referenced 1. The casing 1 has an outer casing 2 and comprises in spaced relationship therefrom, an inner wall 3. The bottom of the combustion chamber consists of a single plate 4 provided with an outlet 5 for condensate. The upper side of the combustion chamber comprises a flue outlet 6.

A burner 7 provided in a side wall of the combustion chamber comprises a mixing chamber 8 which is on the one hand in communication with a device 9 for feeding air and fuel and which on the other hand at its outlet side, is provided with a burner plate 10 having evenly divided ports formed therein. The burner has an oblong shape and extends perpendicular to the plane of the drawing, almost along the entire width of the combustion chamber. The cross-section of the mixing chamber stays constant along the entire length of the burner.

Inside the combustion chamber a heat exchanger is arranged which consists of a number of pipes 11 provided with lamelli(strips), the pipes being interconnected outside the combustion chamber by means of pipe connections, illustrated in the figure with broken lines. Fluid to be heated flows through the pipes 11. The heat exchanger consists of two sections, one section being arranged in an arc around the burner plate 10, the second section being arranged near the bottom plate 4. Both sections are surrounded by guiding plates 12, 13 and 14 which serve for guiding the flue gases and the produced condensate.

Figure 2:
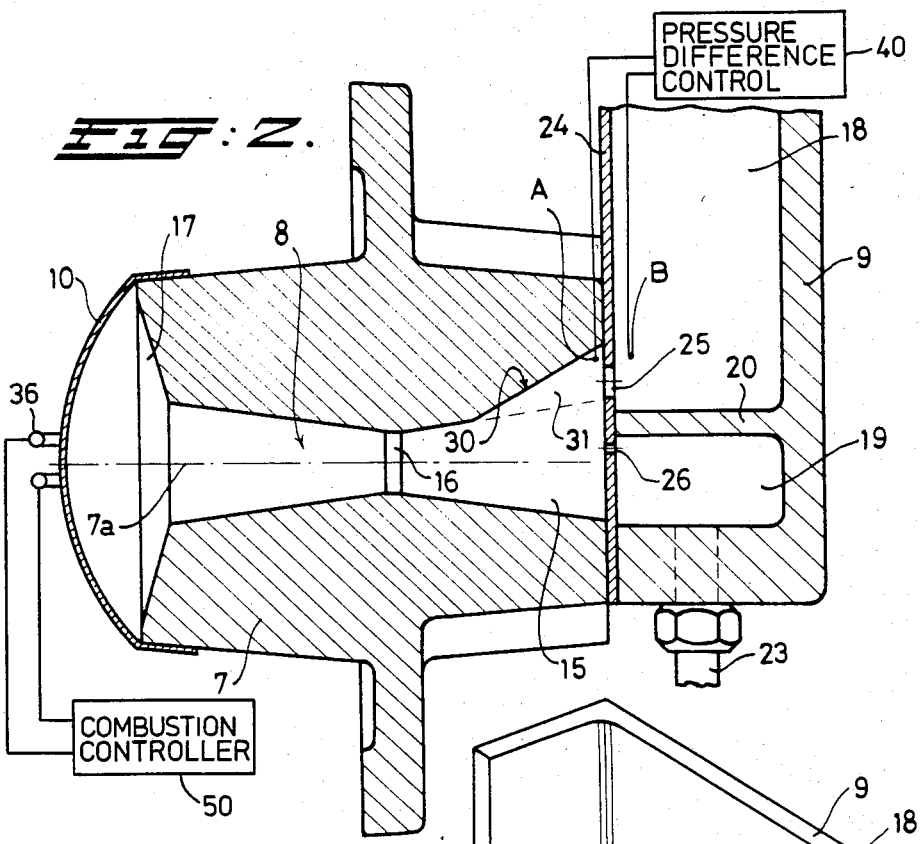
FIG. 2 is a cross section on an enlarged scale through the burner and the feeding device.

Referring now to FIG. 2, it can clearly be seen that the mixing chamber 8 of the burner 7 consists of a converging inlet part 15 which merges into a widening outlet part 17 through a throat 16. The housing of the feeding device 9 has two chambers 18, 19 which are separated from each other by means of a partition wall 20. The chamber 18 is connected to a fan 22 via an air duct 21, whilst a chamber 19 comprises a fuelfeed 23. Between the housing of the feeding device 9 and the burner 7 a restriction plate 24 is mounted which plate comprises two rows of openings 25, 26 (FIG. 3), the rows extending across the entire length of the mixing chamber. Each row of openings 25, 26 connects one of the chambers 18, 19 of the feeding device 9 to the inlet part 16 of the mixing chamber 8, thus allowing air and fuel to enter said mixing chamber in two separate sets of jets.

Figure 3:
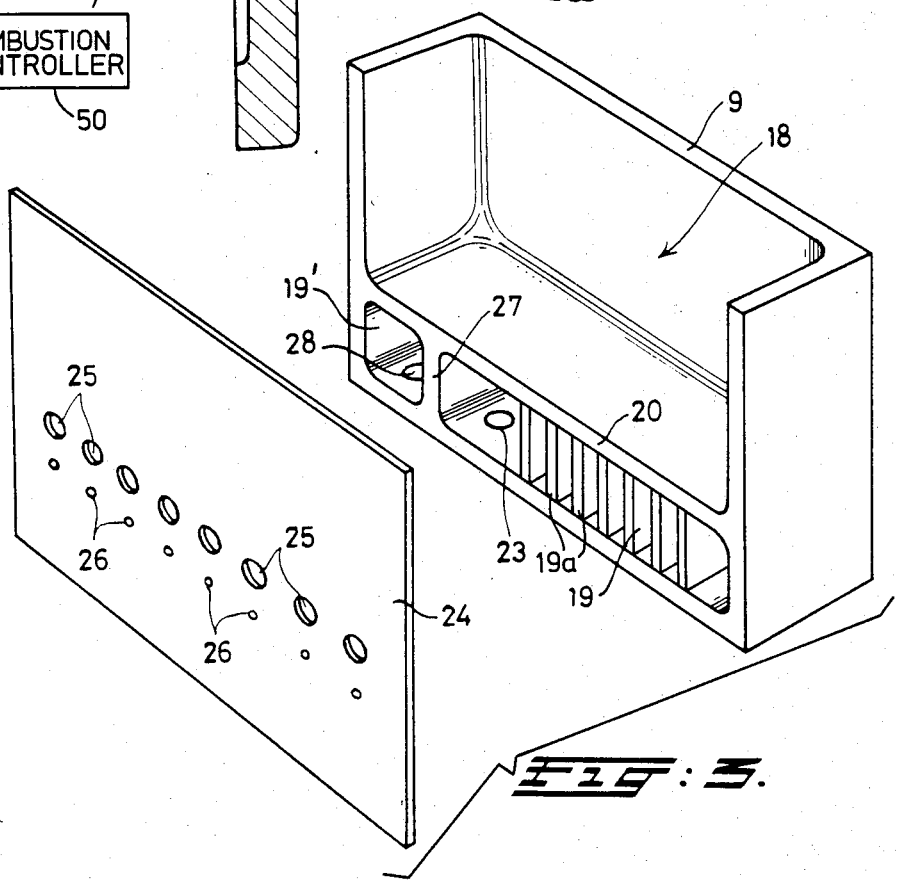
FIG. 3 is a perspective view of the feeding device with a separated restriction plate.

Chamber 19 of the feeding device 9 comprises a partition wall 27 which forms a separate small chamber 19', the chamber being provided with its own gasfeed 28 (see FIG. 3).

Figure 5:
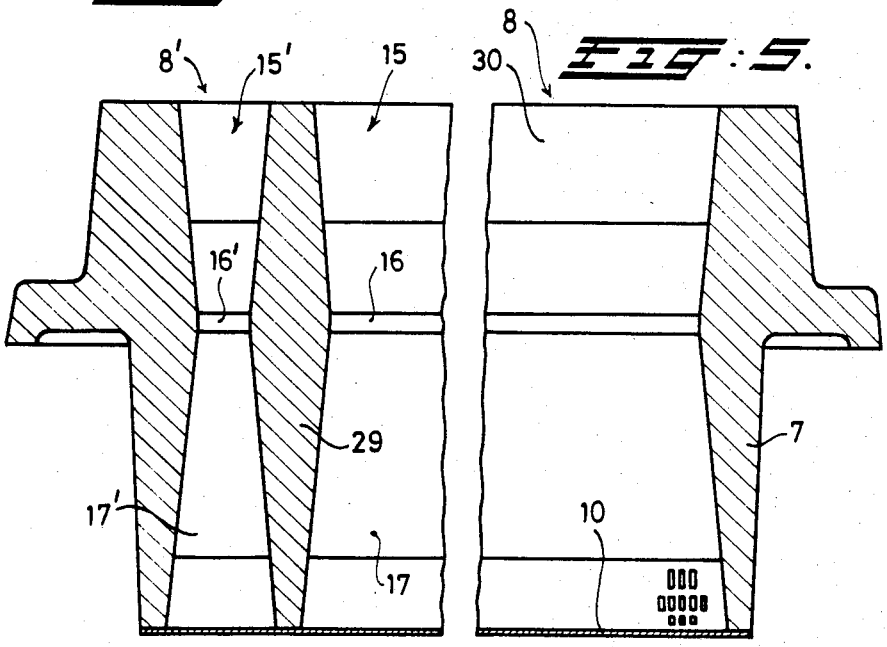
FIG. 5 is a longitudinal section through the burner according to line V—V in FIG. 4.

Referring now to FIG. 5 it appears, in a longitudinal section through burner 7, that the mixing chamber 8 comprises a partition wall 29 which, in a mounted position of the burner and feeding device, is in alignment with wall 27 of the feeding device 9, which wall forms a separate mixing compartment 8' (FIG. 3). This mixing compartment also consists of a converging inlet part 15', a throat 16' and a widening outlet part 17' and comprises its own gasfeed and airfeed. The portion of the burner plate 10 adjoining the discharge part 17' can therefore only be ignited by means of said compartment 8', said portion so functioning as an ignition flame for said burner. Said ignition flame is thus entirely integral with the burner.

Figure 4:
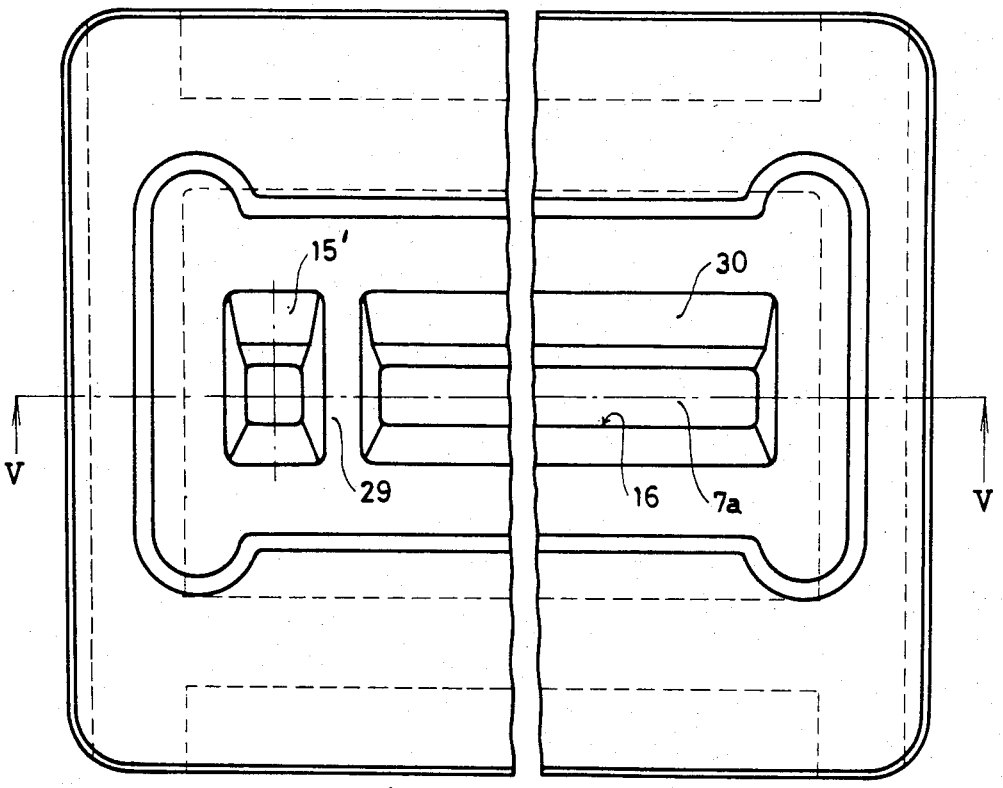
FIG. 4 is a view of the inlet part of the burner.

Reverting now to FIG. 2 part 30 of the upper wall of the inlet part 15, adjacent the restriction plate 24 of the feeding device 9, and asymmetrical with respect to the lower wall of inlet part 15, has a greater angle of inclination than the lower wall, thereby converging more rapdily toward the throat portion 16, thus causing inlet part 15 to be locally widened by a whirling space 31. Openings 25 of chamber 18 connected to airfeed 21 and fan 22 are facing the whirling space such, that the incoming air jets come into contact with the more inclined wall 30 and will be deflected by said wall so that these jets are divided along the inlet part 15. On the other hand openings 26 of chamber 19 connected with the fuel feed, are positioned above the center line 7*a* of the burner near the partition wall 20. It can be seen that the entering fuel jets will come into contact with the air jets deflected by wall 30 so that an appropriate mixture will be obtained (see also FIG. 4).

The burner according to the present invention also comprises a pressure difference control switch (not shown) which on the one hand measures the pressure in the mixing chamber and on the other hand the pressure in chamber 18 connected to the airfeed. The flow of mixture through the burner can be sensed by means of the pressure difference control switch. The sure difference control switch determines any risks of danger which might e.g. occur by a blockage of the openings and automatically cuts off the gasfeed. The pressure difference control switch 40 is appropriately connected in the whirling space at point A and in chamber 18 at point B (FIG. 2). At point A the pressure is lower than the ambient atmosphere, because of air jets entering the whirling space. This has the advantage that the pressure difference control switch will also react when getting disconnected from the whirling space so that in that case too the gasfeed is cut off.

In order to obtain a uniform combustion along the entire burner plate 10, it is important that the fuel jets enter the inlet part 15 in a direction perpendicular to the restriction plate 24 i.e., horizontally. However, the fuel flows from fuel feed 23 sideways through chamber 19, so that the fuel jets entering from ports 26 have a sidewise component of velocity (in FIG. 2 perpendicular to the plane of the drawing). The result of the latter is that the fuel is not uniformly divided along the entire length of the mixing chamber. In order to obviate the above difficulty, the present invention proposes to provide chamber 19 with guiding partitions 19*a* arranged perpendicular to the restriction plate 24, between each of the openings 26.

Since an intensive mixture takes place in the mixing chamber of the burner, the burner may be relatively small which contributes to a compact construction of the entire heater according to the present invention. The small outlet speed of the mixture and the mixing of the fuel with the total amount of air results in a small flame height of approximately 15 mm during the combustion. Pipes 11 of the heat exchanger may therefore be disposed from burner plate 10 at a distance of approximately 20 mm.

The first section of the heat exchanger being arranged in an arc around the burner plate 10, is surrounded by guiding plates 12 and 13 comprising openings through which the flue gases flow toward the second section of the heat exchanger situated near the bottom plate 4, according to arrows 32 (FIG. 1). The flue gases are cooled in the second section to below their condensation temperature. The lower side of the second section is provided with a guiding plate 14 comprising openings 33 (FIG. 1). Through the openings 33 the formed condensate will fall upon the bottom plate 4 and be discharged through outlet 5. Subsequently cooled flue gases will flow upwardly through the channel formed by the inner wall 3 and guiding plate 12, and will thereupon be discharged from the combustion chamber through outlet 6 (arrows 34 in FIG. 1).

An electronic ignitor 35 is disposed near the ignition flame portion of burner plate 10 while a sensor 36 is located near the remaining part of burner plate 10 in order to determine if the combustion is taking place (FIG. 1). The side wall of the combustion chamber is provided with a glass plate 37 for a visual inspection of the burner. The entire burner with the feeding device is arranged in such a manner that it can easily be removed for cleaning purposes.

It has been found in practice that the quantity of $CO_2$ in the flue gases, at a certain load of the heater, depends upon the temperature of the burner plate. The $CO_2$ percentage is an indication whether the burner operates with the correct air-fuel ratio. In case the airfeed is too low the $CO_2$ percentage increases thus causing CO to be produced, whilst a too large airfeed decreases the $CO_2$ percentage, thus decreasing the efficiency of the combustion. In order to achieve an efficiency of the heater which is as optimum as possible, the $CO_2$ percentage has to be maintained within given limits. The optimum $CO_2$ percentage of normal natural gas is 11,7%, the percentage being slightly lower in practice so that in general $CO_2$ percentage is approximately 9 to 10%. It has been found in practice that a deviation of 1% in the $CO_2$ percentage corresponds to a difference in temperature of the burner plate 10 of approximately 50° C. Due to this relative high temperature difference a very accurate control of the combustion in the heater according to the invention can be obtained. The temperature of the burner plate may be measured and the air-fuel ratio in the burner may be controlled, depending upon the measured temperature value, with combustion controller 50.

The heater according to the invention will in this manner have a very compact structure and an extremely high efficiency exceeding the required 90%.

As the air and fuel are fed separately into the mixing chamber via the restriction plate 24, the capacity of the burner can easily be changed by replacing the restriction plate. The fan in the airfeed causes a forced draught in the combustion chamber but also supplies the energy required for the mixing procedure.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A heater comprising:

a combustion chamber;

a burner disposed within said combustion chamber for burning fuel;

a heat exchanger arranged within said combustion chamber for heating a heat exchange fluid;

a mixing chamber operatively associated with said burner, said mixing chamber having a converging asymmetrical inlet portion, a throat portion and a diverging outlet portion communicating with said inlet portion via said throat portion;

means for feeding fuel to said burner, said means for feeding fuel connected to said mixing chamber;

means for forcing air into said mixing chamber;

a burner plate provided on said outlet portion of said mixing chamber, said burner plate having a plurality of evenly divided ports formed therein;

a restriction plate having a plurality of calibrated openings formed therein for forming jets of air and fuel and provided on said inlet portion of said mixing chamber;

a feeding device for feeding air and fuel into said inlet portion of said mixing chamber through said restriction plate, said feeding device having a first chamber formed therein connected to said means for forcing air into said mixing chamber and having a separate second chamber formed therein connected to said means for feeding fuel to said burner; and means for deflecting said jets of air and fuel comprising a whirling space defined by wall portions of said inlet portion of said mixing chamber, a first one of said wall portions extending from said restriction plate and converging more rapidly toward said throat portion than on opposing second one of said wall portions, such that a small flame is produced by said burner.

2. The heater of claim 1 further comprising means for measuring the temperature of the burner plate and means for controlling the ratio of air to fuel supplied to said burner as a function of the measured temperature of the burner plate.

3. The heater of claim 1, wherein the burner is provided with a pressure difference control switch which is connected to the whirling space of the mixing chamber adjacent the restriction plate and connected to the first chamber of the feeding device.

4. The heater of claim 1, wherein the mixing chamber of the burner comprises a separate mixing compartment for mixing air and fuel to produce an ignition flame for said burner and extending from the feeding device to the burner plate, said feeding device comprising a separate feeding chamber exclusively in communication with said mixing compartment, said separate feeding chamber having a separate means for feeding fuel thereto.

5. The heater of claim 1, wherein a first set of said plurality of calibrated openings faces the whirling space, and a second set of said plurality of calibrated openings of the restriction plate being arranged near the level of the throat portion of the mixing chamber.

6. The heater of claim 1, wherein the second chamber of the feeding device is provided with guiding partitions arranged between each opening, perpendicular to the restriction plate.

7. The heater of claim 1, wherein the burner is located in a side wall of the combustion chamber, the jets of air and fuel through the mixing chamber being directed in a substantially horizontal path through the combustion chamber.

8. The heater of claim 1, wherein the plurality of openings in the restriction plate of the feeding device are located in two parallel rows in the longitudinal direction of the burner.

9. A heater comprising:

a combustion chamber;

a burner disposed within said combustion chamber for burning fuel;

a heat exchanger arranged within said combustion chamber for heating a heat exchange fluid;

a mixing chamber operatively associated with said burner, said mixing chamber having a converging inlet portion, a throat portion and a diverging outlet portion communicating with said inlet portion via said throat portion;

means for feeding fuel to said burner, said means for feeding fuel connected to said mixing chamber;

means for forcing air into said mixing chamber;

a burner plate provided on said outlet portion of said mixing chamber, said burner plate having a plurality of evenly divided ports formed therein;

a restriction plate having a plurality of calibrated openings formed therein for forming jets of air and fuel and provided on said inlet portion of said mixing chamber;

a feeding device for feeding air and fuel into said inlet portion of said mixing chamber through said restriction plate, said feeding device having a first chamber formed therein connected to said means for forcing air into said mixing chamber and having a separte second chamber formed therein connected to said means for feeding fuel to said burner; and means for deflecting said jets of air and fuel comprising a whirling space defined by an upper wall portion and side portions of said inlet portion of said mixing chamber, said upper wall portion extending from said restriction plate and converging more rapidly toward said throat portion than a corresponding lower portion of said inlet portion to form an asymmetrical inlet portion.

* * * * *